US010145330B2

(12) United States Patent
Kim et al.

(10) Patent No.: US 10,145,330 B2
(45) Date of Patent: Dec. 4, 2018

(54) CYLINDER LINER FOR INSERT CASTING AND METHOD FOR MANUFACTURING THE SAME

(71) Applicant: Hyundai Motor Company, Seoul (KR)

(72) Inventors: Young-Gi Kim, Seoul (KR); Hun-Young Park, Ulsan (KR)

(73) Assignee: Hyundai Motor Company, Seoul (KR)

( * ) Notice: Subject to any disclaimer, the term of this patent is extended or adjusted under 35 U.S.C. 154(b) by 108 days.

(21) Appl. No.: 15/284,648

(22) Filed: Oct. 4, 2016

(65) Prior Publication Data

US 2017/0328299 A1 Nov. 16, 2017

(30) Foreign Application Priority Data

May 13, 2016 (KR) ..... 10-2016-0058726

(51) Int. Cl.

| | |
|---|---|
| ***F02F 1/00*** | (2006.01) |
| ***C23C 4/067*** | (2016.01) |
| ***C23C 4/11*** | (2016.01) |
| ***B22D 19/00*** | (2006.01) |
| ***C23C 4/131*** | (2016.01) |

(52) U.S. Cl.

CPC ..... *F02F 1/004* (2013.01); *B22D 19/0009* (2013.01); *C23C 4/067* (2016.01); *C23C 4/11* (2016.01); *C23C 4/131* (2016.01); *F02F 2200/00* (2013.01)

(58) Field of Classification Search

CPC ..... F02F 1/004; F02F 2200/00; C23C 4/067; C23C 4/11; C23C 4/131; B22D 19/0009

USPC ..... 123/193.2; 428/650, 653, 632, 633, 469, 428/640, 639; 427/449–456, 318, 319, 427/62, 97.3, 126.3, 376.4, 376.5; 423/275; 228/261; 239/80, 81, 83, 84; 29/888.06, 888.061

See application file for complete search history.

(56) References Cited

U.S. PATENT DOCUMENTS 4,752,535 A * 6/1988 Kvernes ..... C23C 4/02 427/452
4,921,734 A * 5/1990 Thorpe ..... F02F 7/0087 123/193.2
5,571,344 A * 11/1996 Dubois ..... C22C 21/003 126/390.1
6,025,078 A * 2/2000 Rickerby ..... C04B 35/486 427/419.2
6,080,360 A * 6/2000 Pfeffinger ..... C23C 4/04 420/534

(Continued)

FOREIGN PATENT DOCUMENTS

JP 3383592 B2 3/2003
KR 2008-0021125 A 3/2008

(Continued)

*Primary Examiner* — Thomas Moulis
*Assistant Examiner* — John Bailey
(74) *Attorney, Agent, or Firm* — Mintz Levin Cohn Ferris Glovsky and Popeo, P.C.; Peter F. Corless

(57) ABSTRACT

Disclosed are a cylinder liner for insert casting and a method for manufacturing the same. In particular, the cylinder liner for insert casting has cooling and warming performances suitable for functions of respective parts by imparting multiple layers having different thermal conductivity on the surface of the cylinder liner for insert casting, such that the cylinder liner can be used for vehicle cylinder blocks.

19 Claims, 7 Drawing Sheets

(56) References Cited

U.S. PATENT DOCUMENTS 6,221,504 B1 * 4/2001 Pfeffinger ..... B22F 1/0096 428/558
6,256,984 B1 * 7/2001 Voss ..... B01D 53/944 422/180
6,361,877 B1 * 3/2002 Miyai ..... C22C 21/02 427/452
6,803,078 B2 * 10/2004 Haug ..... C23C 4/12 427/190
7,191,770 B1 * 3/2007 Anderson ..... F02F 1/004 123/193.2
8,505,438 B2 * 8/2013 Choi ..... B22D 13/023 29/888.06
9,816,458 B2 * 11/2017 Sakai ..... F02F 1/00
2001/0037786 A1 * 11/2001 Fischer ..... B22D 15/02 123/193.2
2002/0073982 A1 * 6/2002 Shaikh ..... C23C 24/04 123/688
2007/0012175 A1 * 1/2007 Miyamoto ..... B22D 19/0009 92/171.1
2007/0012176 A1 * 1/2007 Takami ..... B22D 19/0009 92/171.1
2007/0012177 A1 * 1/2007 Miyamoto ..... B22D 19/0009 92/171.1
2007/0012179 A1 * 1/2007 Takami ..... B22D 19/0009 92/171.1
2007/0012180 A1 * 1/2007 Miyamoto ..... B22D 19/0009 92/171.1
2007/0084449 A1 * 4/2007 Najt ..... F01L 3/04 123/668
2010/0055479 A1 * 3/2010 Beardsley ..... C23C 4/06 428/457
2010/0139607 A1 * 6/2010 Herbst-Dederichs ..... C23C 4/02 123/193.2
2015/0020757 A1 * 1/2015 Highum ..... B22D 19/0081 123/41.01
2015/0122118 A1 * 5/2015 He ..... C23C 4/04 92/171.1
2015/0219039 A1 * 8/2015 Weber ..... B05D 3/0254 123/193.2
2016/0356239 A1 * 12/2016 Graham ..... F02F 1/004
2017/0145950 A1 * 5/2017 Yamashita ..... F02F 3/12
2017/0145952 A1 * 5/2017 Lineton ..... C23C 4/02

FOREIGN PATENT DOCUMENTS

KR 2008-0027927 A 3/2008
KR 2008-0027928 A 3/2008
KR 2008-0043306 A 5/2008
KR 10-1509769 B1 4/2015

* cited by examiner

CYLINDER LINER FOR INSERT CASTING AND METHOD FOR MANUFACTURING THE SAME

CROSS-REFERENCE TO RELATED APPLICATION

This application claims the priority benefit of Korean Patent Application No. 10-2016-0058726, filed on May 13, 2016 in the Korean Intellectual Property Office, the disclosure of which is incorporated herein by reference.

TECHNICAL FIELD

The present invention relates to a cylinder liner for insert casting and a method for manufacturing the same. In particular, the cylinder liner for insert casting may have cooling and warming performances suitable for functions of respective parts used for vehicle cylinder blocks, for example, by imparting multiple layers having different thermal conductivity to the cylinder liner.

BACKGROUND OF THE INVENTION

A combustion chamber of an engine includes a cylinder block, a piston and a cylinder head. The temperature of the metal surface of the combustion chamber is controlled at a temperature of about 200° C. so that engine oil can be used. For this purpose, the respective parts need to be cooled. For example, the cylinder block and the cylinder head can be cooled using an engine coolant and the piston can be cooled by spraying oil onto a lower part of the piston.

When cooling of the combustion chamber is not favorable, the temperature of the combustion chamber is increased, abnormal combustion occurs and thus engine hunting occurs. In addition, oil temperature may increase, lubrication function may deteriorate and oil consumption may increase.

Accordingly, in order to reinforce cooling of the combustion chamber, research has been conducted on coating the surfaces of cast iron liners used for cylinder blocks with an aluminum material having a high thermal conductivity.

When a bore of the cylinder block constitutes a combustion chamber and allows the piston to reciprocate, an upper part of the combustion chamber should be cooled well, whereas middle and lower parts of the combustion chamber in which the piston reciprocates need to maintain the temperature well so as to maintain viscosity.

Meanwhile, as the temperature of the cylinder increases, the cylinder bore thermally expands. As a result, the temperature of the cylinder may be changed between positions according to direction of the axis line of the cylinder. Accordingly, variation of the cylinder bore is also changed according to the axis line direction due to thermal expansion. The difference in variation of the cylinder bore may cause an increase in friction of the piston and deteriorating fuel consumption.

In an attempt to solve the above mentioned problems in the related arts, the present invention may provide a cylinder liner for insert casting which may have cooling and warming properties suitable for functions of respective parts of the bore and a method for manufacturing the same.

SUMMARY OF THE INVENTION

In preferred aspects, the present invention may provide a cylinder liner for insert casting. The cylinder liner may improve unsmooth cooling and warming of the respective parts, which has been the problem of conventional cylinder liners for insert casting. In addition, the cylinder liner of the present invention may include multiple layers having different thermal conductivities and impart such properties to the bore and thus may have the functions of cooling and warming suitable for functions of respective parts of the bore.

Additionally, the present invention may provide a cylinder liner for insert casting which may reinforce cooling of an upper part of a combustion chamber bore by applying heat radiation coating thereto, and may prevent cooling of oils of piston slideway. As consequence, friction thereof may be reduced by applying a heat insulation coating having lower thermal conductivity than the heat radiation coating layer to middle and lower parts requiring warming and functions of both cooling the combustion chamber and warming oils of piston slideway may be provided.

The objects of the present invention are not limited to those described above and other objects not stated herein may be clearly understood by those skilled in the art from the following description.

In one aspect, provided is a cylinder liner for insert casting, which may include: a first heat radiation coating layer on an outer circumference surface of an upper part of a cylinder liner, and a heat insulation on an outer circumference surface of a lower part of the cylinder liner. In certain preferred aspects, the coating layers (heat radiation coating layers and heat insulation coating layer will have a difference in thermal conductivity between about 1, 5, 10, 20 or 50 to about 500 W/mk, between about 1, 5, 10, 20 or 50 to about 400 W/mk, between about 1, 5, 10, 20 or 50 to about 300 W/mk, or suitably between about 1, 5, 10, 20 or 50 to about 200 W/mk.

In particular, the heat insulation coating layer may have a lower thermal conductivity than a thermal conductivity of the first heat radiation coating layer. For example, the heat insulation coating layer may have a thermal conductivity that is lower at least by about 1, 5, 10, 20, 30, 50, 100, 200, 250, 300, 400, or 500 W/mk than the thermal conductivity of the first heat radiation coating layer.

As referred to herein, a "thermal conductivity" of a heat insulation coating layer or a heat radiation coating layer may be defined by the following protocol: coating (heat insulation coating layer and heat radiation coating layer) layers may be measured with a quantity of heat that passes in unit time through the coating layers at particular area and/or given thickness, e.g. of about 0.02 to 0.3 mm for heat radiation layer, and of about 0.13 to 0.17 mm for heat insulation layer. The cylinder liner may further include a second heat radiation coating layer on the heat radiation coating layer of the upper outer circumference surface and on the heat insulation coating layer of the lower outer circumference surface.

The first heat radiation coating layer may comprise an aluminum (Al) material.

The term "aluminum material" as used herein refers to a material including aluminum as major component, for example, having a Al content greater than about 50 wt %, greater than about 60 wt %, greater than about 70 wt %, greater than about 80 wt %, greater than about 90 wt %, or greater than about 95 wt %, based on the total weight of the material. The aluminum material may include, but not limited to, a compound, a composite or an alloy comprising aluminum as major component.

The first heat radiation coating layer may comprise an amount of about 8 to 12 wt % of silicon (Si) based on the total weight of the first heat radiation coating layer, and aluminum (Al) constituting the remaining balance thereof.

Preferably, the first heat radiation coating layer may have a thickness of about 0.02 to 0.3 mm, or particularly, 0.08 to 0.3 mm.

The first heat radiation coating layer may be formed, for example, by thermal spraying or other suitable applicator. For example, thermal spraying suitably may be either flame thermal spraying or electric arc thermal spraying.

The second heat radiation coating layer may comprise an aluminum (Al) material.

Likewise, the second heat radiation coating layer may comprise an amount of about 8 to 12 wt % of silicon (Si) based on the total weight of the second heat radiation coating layer, and aluminum (Al) constituting the remaining balance thereof.

Preferably, the second heat radiation coating layer may have a thickness of about 0.02 to 0.3 mm, or particularly, 0.08 to 0.3 mm.

The second heat radiation coating layer may be formed by thermal spraying. For example, thermal spraying suitably may be either flame thermal spraying or electric arc thermal spraying.

The heat insulation coating layer may include aluminum oxide ($Al_2O_3$).

The heat insulation coating layer may include yttrium oxide ($Y_2O_3$) and zirconium dioxide (ZrO).

The heat insulation coating layer may comprise an amount of about 5 to 20 wt % of yttrium oxide based on the total weight of the heat insulation coating layer and zirconium dioxide constituting the remaining balance thereof.

The heat insulation coating layer suitably may have a thickness of about 0.13 to 0.17 mm.

In another aspect of the present invention, provided is a method for producing a cylinder liner for insert casting. The method may include forming a first heat radiation coating layer on an upper outer circumference surface of a cylinder liner, and forming a heat insulation on a lower outer circumference surface of the cylinder liner. As discussed above, in certain preferred aspects, the coating layers (heat radiation coating layers and heat insulation coating layer will have a difference in thermal conductivity between about 1 to 500 W/mk, between about 1 to 400 W/mk, between about 1 to 300 W/mk, or suitably between about 1 to 200 W/mk.

In particular, the heat insulation coating layer may have a lower thermal conductivity than a thermal conductivity of the first heat radiation coating layer. For example, the heat insulation coating layer may have a thermal conductivity that is lower at least by about 1, 5, 10, 20, 30, 50, 100, 200, 250, 300, 400, or 500 W/mk than the thermal conductivity of the first heat radiation coating layer.

The method may further include forming a second heat radiation coating layer on the heat insulation coating layer and the first heat radiation coating layer, after forming the heat insulation coating layer on the lower outer circumference surface of the cylinder liner.

The heat insulation coating layer may be formed by a thermal spray coating using a coating material comprising an amount of about 5 to 20 wt % of yttrium oxide based on the total weight of the coating material and zirconium dioxide constituting the remaining balance of the coating material.

The first heat radiation coating layer suitably may be formed by an arc thermal spray coating using a coating material containing 100 wt % of aluminum, or an amount of about 8 to 12 wt % of silicon based on the total weight of the coating material and aluminum constituting the remaining balance of the coating material.

The second heat radiation coating layer suitably may be formed by an arc thermal spray coating using a coating material containing 100 wt % of aluminum, or an amount of about 8 to 12 wt % of silicon based on the total weight of the coating material and aluminum constituting the remaining balance of the coating material.

Further provided is a vehicle that may comprise the cylinder liner as described herein.

Other aspects of the invention are disclosed infra.

BRIEF DESCRIPTION OF THE DRAWINGS

The above and other objects, features and other advantages of the present invention will be more clearly understood from the following detailed description taken in conjunction with the accompanying drawings, in which.

The above and other objects, features and other advantages of the present invention will be more clearly understood from the following detailed description taken in conjunction with the accompanying drawings, in which.

DETAILED DESCRIPTION

Figure 1:
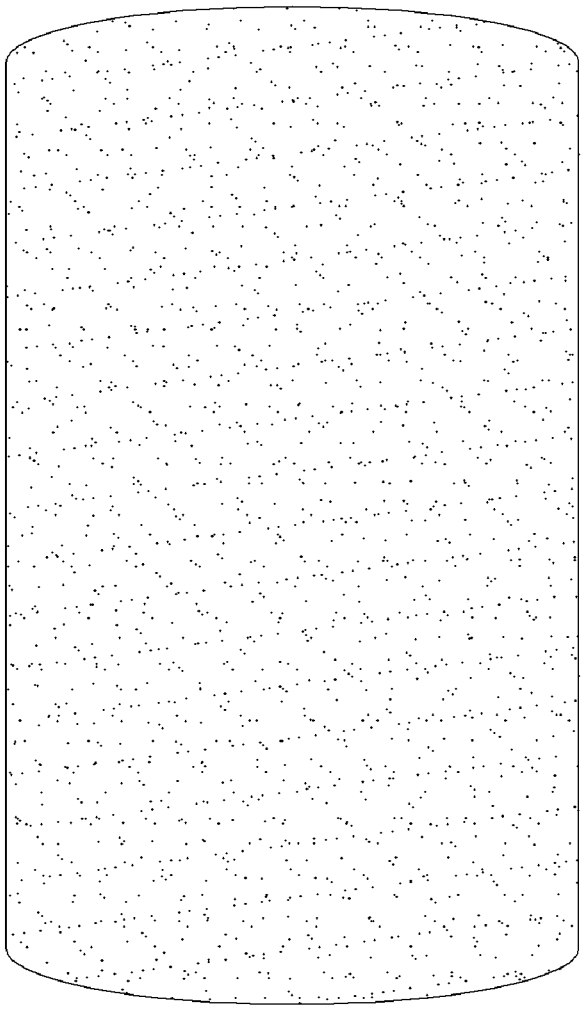
FIG. 1 illustrates an exemplary cast iron cylinder liner having an outer circumference surface coated with aluminum.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Hereinafter, embodiments of the present invention will be described in detail with reference to the accompanying drawings. Prior to this, the terms and words used in the present specification and claims should not be construed to be limited to the common or dictionary meaning, because an inventor can define the concept of the terms appropriately to describe his/her invention in the best manner. Therefore, they should be construed as a meaning and concept fit to the technological concept and scope of the present invention. Therefore, the embodiments and configurations described in the drawings of the present specification are nothing but preferred embodiments of the present invention, and they do not represent all of the technological concept and scope of the present invention. Therefore, it should be understood that there can be many equivalents and modified embodiments that can substitute those described in this specification at the time of application.

In a broad sense, a combustion chamber of an engine includes a cylinder block, a piston and a cylinder head. The temperature of the metal surface of the combustion chamber is controlled to about 200° C. so that engine oil can be used. For this purpose, the respective parts need to be cooled. Accordingly, the cylinder block and the cylinder head are cooled using an engine coolant and the piston is cooled by spraying oil onto a lower part of the piston.

Meanwhile, a bore of the cylinder block which constitutes a combustion chamber and allows the piston to reciprocate, an upper part of the combustion chamber should be cooled well, whereas middle and lower parts of the combustion chamber in which the piston reciprocates should be kept warm well to maintain viscosity.

When cooling of the combustion chamber is not favorable, the temperature of the combustion chamber is increased, abnormal combustion occurs and thus engine hunting occurs. In addition, there occur problems of increased oil temperature, deteriorated lubrication function and increased oil consumption.

In an attempt to solve these problems of the prior art, the present invention is devised to provide a cylinder liner for insert casting which has cooling and warming properties suitable for functions of respective parts of the bore and a method for manufacturing the same.

Figure 2A:
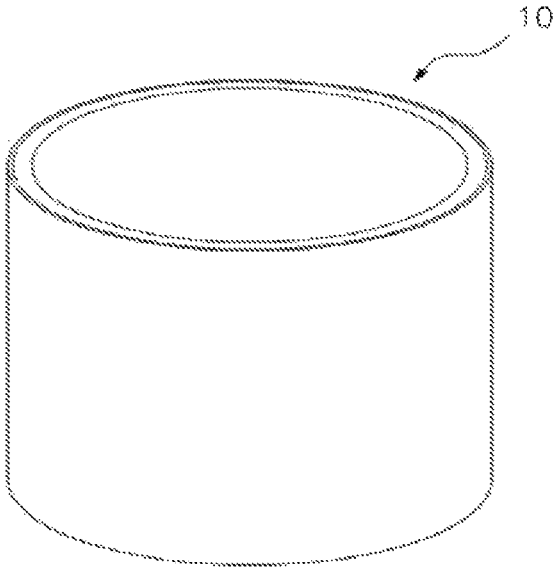
FIG. 2A illustrates a conventional cylinder liner in the related art.
Figure 2B:
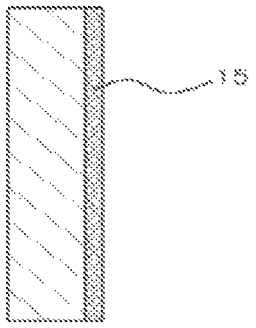
FIG. 2B illustrates a sectional view of a conventional cylinder liner in the related art.

In one preferred aspect, the cylinder liner for insert casting of the present invention may include a first heat radiation coating layer 15 formed on an outer circumference surface of an upper part 11 of a cylinder liner 10, and a heat insulation coating layer 16 formed on an outer circumference surface 14 of a lower part 12 of the cylinder liner 10. In particular, the heat insulating coating layer 16 may have a lower thermal conductivity than a thermal conductivity of the first heat radiation coating layer 15, FIG. 2A illustrates a conventional cylinder liner in the related art and the cylinder liner for insert casting may be generally made of cast iron and have a cylindrical shape. As shown in FIG. 2B, an aluminum-made heat radiation coating 15 may be applied to an outer circumference surface of a liner in order to reinforce combustion chamber cooling.

Figure 3:
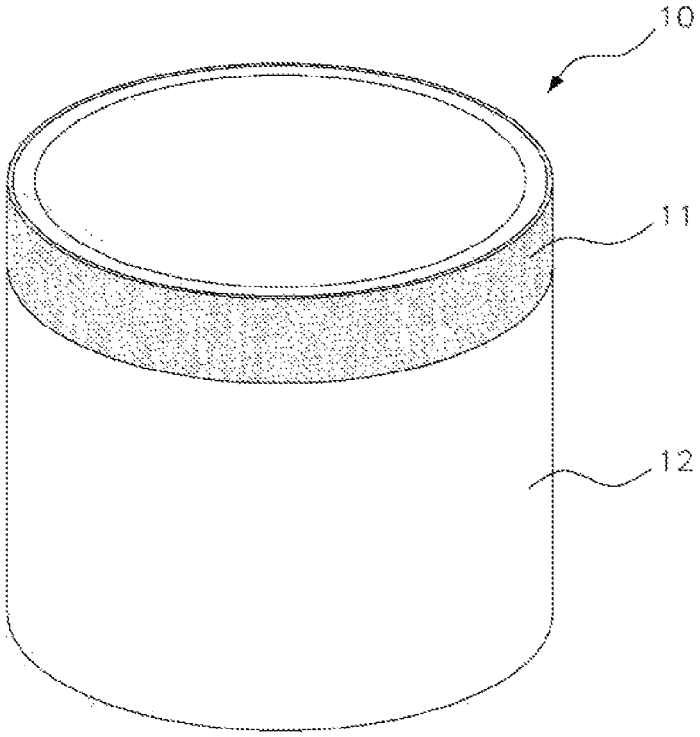
FIG. 3 illustrates a perspective view of an exemplary cylinder liner for insert casting according to an exemplary embodiment of the present invention.

Meanwhile, FIG. 3 illustrates an exemplary cylinder liner for insert casting according to an exemplary embodiment of the present invention. As described above, the cylinder bore may be divided into upper and lower parts depending on difference in required thermal conductivities, and in order to optimize features of the cylinder bore, the first heat radiation coating may be applied to the upper part, thereby reinforcing cooling, and heat insulation coating having a lower thermal conductivity than that of the first heat radiation coating layer may be applied to middle and lower parts requiring warming.

The cylinder liner for insert casting of the present invention may further include a second heat radiation coating layer 15 on the first heat radiation coating layer of the upper outer circumference surface 13 and on the heat insulation coating layer 16 of the lower outer circumference surface 14.

Preferably, the first heat radiation coating layer 15 and the second heat radiation coating layer 15 may have the same, the same composition, and/or same thickness. Suitable composition of these heat radiation coating layers may include an aluminum (Al) material, for example, aluminum composition containing an amount of about 8 to 12 wt % of silicon (Si) and aluminum (Al) constituting the remaining balance, based on the total weight of the heat radiation coating layer. Suitably thickness of these heat radiation coating layers may be about 0.02 to 0.3 mm, or particularly about 0.08 to 0.3 mm.

Figure 4A:
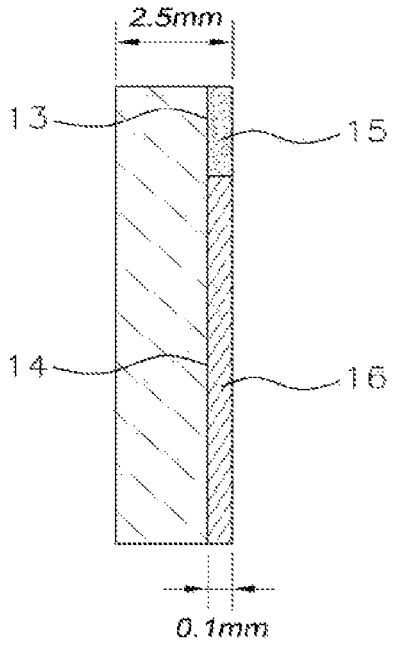
FIG. 4A is a sectional view illustrating an exemplary cylinder liner for insert casting according to an exemplary embodiment of the present invention.
Figure 4B:
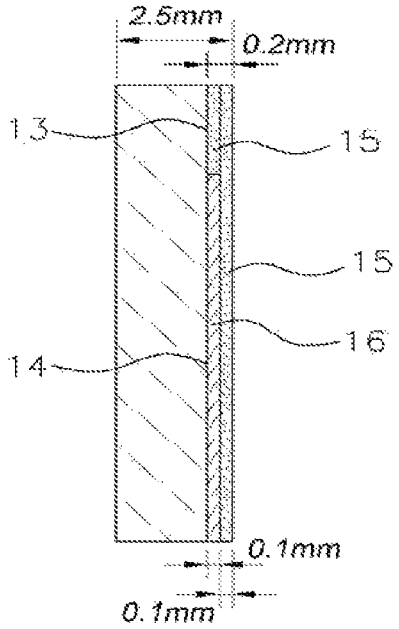
FIG. 4B is a sectional view illustrating an exemplary cylinder liner including a second heat radiation coating layer for insert casting according to an exemplary embodiment of the present invention.

FIG. 4A is a sectional view illustrating an exemplary cylinder liner for insert casting according to an exemplary embodiment of the present invention. Heat radiation coating may be applied to the upper part of the cast iron liner and a heat insulation coating having a lower thermal conductivity than that of the first heat radiation coating layer may be applied to the lower part (type A). In another exemplary embodiment of the present invention, as shown in FIG. 4B, the liner may further include a second heat radiation coating layer 15 formed on the heat radiation coating layer of the upper outer circumference surface thereof and on the heat insulation coating layer of the lower outer circumference surface thereof (type B). The coating having this configuration can further improve adhesive strength to blocks.

In the cylinder liner for insert casting of the present invention, the first heat radiation coating layer and the second heat radiation coating layer may comprise aluminum (Al) or aluminum material as main component.

Preferably, in the cylinder liner for insert casting of the present invention, the first heat radiation coating layer or the second heat radiation coating layer may comprise an amount of about 8 to 12 wt % of silicon (Si) based on the total weight of each the heat radiation coating layer and aluminum (Al) constituting the remaining balance thereof.

When aluminum having high thermal conductivity, for example, having a thermal conductivity of 30 to 40 W/mk, is coated on the outer circumference surface of the cast iron cylinder liner, the aluminum may provide improved heat radiation performance and thus adhesivity to the cylinder block 20, thereby enhancing overall cooling performance.

The following Table 1 shows components and thermal conductivity of different kinds of heat radiation coating materials.

TABLE 1

| Item | Silicon (Si) | Aluminum (Al) | Thermal conductivity |
|---|---|---|---|
| Example 1 | 0 | 100 wt % | 160 to 210 W/mk |
| Example 2 | 8 to 12 wt % | Balance | 100 to 160 W/mk |

Examples 1 and 2 can be selectively used for the present invention depending on required functions. When adhesion between the cylinder liner 10 and the cylinder block 20 is easy, pure aluminum-based Example 1 having a thermal conductivity of about 160 to 210 W/mK may be preferably used as the heat radiation coating material. When strong adhesion between the cylinder liner and the cylinder block is needed, Example 2 having a relatively low thermal conductivity of about 100 to 160 W/mK and made of a similar material to the cylinder block may be preferably used as the heat radiation coating material.

In the cylinder liner for insert casting of the present invention, the first heat radiation coating layer or the second heat radiation coating layer may have a thickness of about 0.02 to 0.3 mm, or particularly, of about 0.08 to 0.3 mm.

In addition, in the cylinder liner for insert casting of the present invention, the heat radiation coating layer (first and second) may be preferably formed by thermal spraying. The thermal spraying suitably may be either thermal spraying or electric arc thermal spraying.

Thermal spray coating is a coating method which conducts lamination by melting a base material including a powder or wire and spraying, as such an outer circumference surface or an inner circumference surface in the form of a monolayer or a multilayer may be coated in order to impart various properties required for parts in the related arts. In general, thermal spray coating may be conducted in order to improve abrasion resistance, high heat resistance and corrosion resistance, and examples thereof may include flame thermal spraying, electric arc thermal spraying, plasma thermal spraying, rapid oxygen fuel thermal spraying and the like according to method for melting materials.

FIG. 1 is an image showing a cast iron cylinder liner having an outer circumference surface coated with aluminum.

The cylinder liner for vehicles commonly include a bore for cylinder blocks requiring cooling function which may be coated with aluminum having superior heat transfer by thermal spray coating.

Meanwhile, in the cylinder liner for insert casting of the present invention, the heat insulation coating layer may include aluminum oxide ($Al_2O_3$) or the heat insulation coating layer may include yttrium oxide ($Y_2O_3$) and zirconium dioxide ($ZrO_2$).

When the coating is conducted using oxide having low thermal conductivity, cooling may be minimized due to heat shielding effect and an effect of maintaining temperature may thus be obtained. In order to maximize heat shielding effect, a coating material having a thermal conductivity less than about 1 W/mk may be preferably used and oxide such as aluminum oxide ($Al_2O_3$), zirconium dioxide ($ZrO_2$) or yttrium oxide ($Y_2O_3$) may be used.

The oxide may be coated singly. Among the oxides, a combination of zirconium dioxide and yttrium oxide suitably may be coated to obtain a synergistic effect.

Accordingly, in the cylinder liner for insert casting of the present invention, the heat insulation coating layer may include an amount of about 5 to 20 wt % of yttrium oxide based on the total weight of the heat insulation layer and zirconium dioxide constituting the remaining balance thereof.

The following Table 2 shows components and thermal conductivity of exemplary heat insulation coating materials.

TABLE 2

| Item | Yttrium oxide ($Y_2O_3$) | Zirconium dioxide ($ZrO_2$) | Thermal conductivity |
|---|---|---|---|
| Example 3 | 5 to 20 wt % | Balance | 1 W/mk or less |

An aluminum oxide coating material may have excellent adhesive strength to an aluminum-made cylinder block and, may be thus preferably applied using the type A coating method, whereas a coating material comprising a combination of zirconium dioxide and yttrium oxide of Example 3 may have less adhesive strength to the aluminum cylinder block and may be thus preferably produced by entire-surface heat radiation coating after heat shielding coating, like type B.

Meanwhile, aluminum cylinder blocks may be produced by high-pressure casting and or particularly, may be produced while surrounding a cast iron-made cylinder liner under a high pressure during casting. Typically, engines require an adhesive strength of about 10 to 30 MPa between the cylinder liner and the cylinder block. In this regard, the cylinder liner of the present invention may provide secured adhesive strength of about 20 to 30 MPa, which may be a sufficient adhesive strength value required for production of engines.

In the cylinder liner for insert casting of the present invention, the heat insulation coating layer suitably may have a thickness of about 0.13 to 0.17 mm.

Figure 5A:
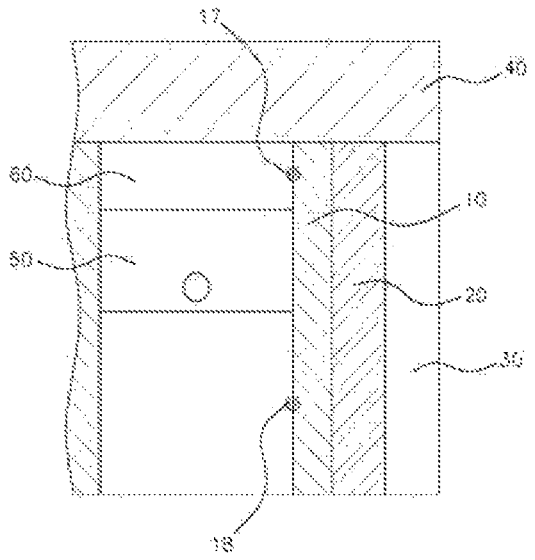
FIG. 5A illustrates an exemplary engine a conventional cylinder liner for insert casting in the related art.
Figure 5B:
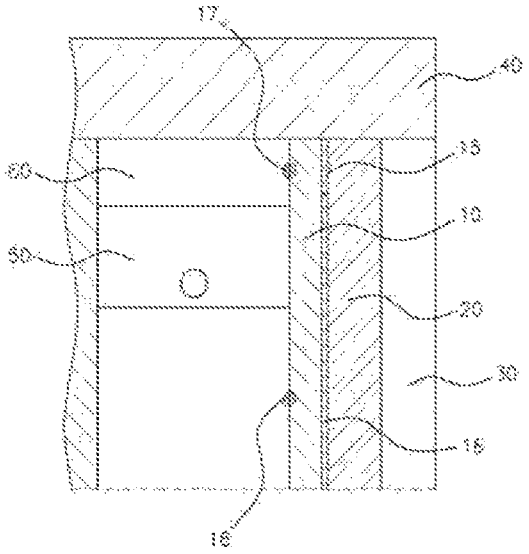
FIG. 5B illustrates an exemplary engine a conventional cylinder liner having different thermal conductivities in upper and lower parts by applying the heat radiation coating for insert casting according to an embodiment of the present invention.

FIG. 5A illustrates an exemplary engine a conventional cylinder liner for insert casting in the related art and an embodiment of the present invention. As compared to the engine according to the prior art, the exemplary cylinder liner according to an exemplary embodiment of the present invention as shown in FIG. 5B may have different thermal conductivities in upper and lower parts by applying the heat radiation coating 15. In particular, the heat insulation coating 16 may have a lower thermal conductivity than a thermal conductivity of the heat radiation coating layer 15 may also be applied to the outer circumference surface.

Figure 6:
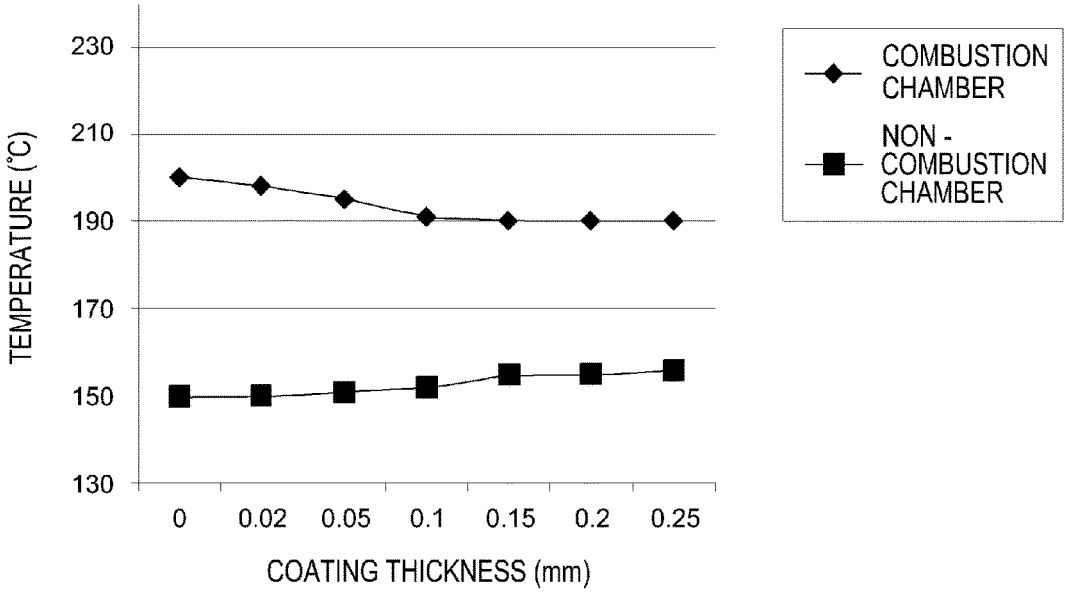
FIG. 6 is a graph showing variation in temperature according to thicknesses of an exemplary heat radiation coating and an exemplary heat insulation coating according to an exemplary embodiment of the present invention.

Meanwhile, FIG. 6 is a graph showing variation in temperature according to thicknesses of the first heat radiation coating and heat insulation coating. With respect to the respective engines including the conventional cylinder liner for insert casting in the related art and an exemplary cylinder liner according to an exemplary embodiment of the present invention, metal surface temperatures of combustion chamber temperature measurement point 17 and non-combustion chamber temperature measurement point 18 were measured in order to evaluate effects.

As can be seen from the result of temperature measurement, the average temperature of the combustion chamber requiring heat radiation performance was about 10° C. less than that required in the related art by applying heat radiation coating. In addition, the average temperature of non-combustion chamber was about 5° C. greater than that in the related art by applying the heat insulation coating having a lower thermal conductivity than that of the first heat radiation coating layer.

Meanwhile, when heat radiation coating is formed to have a thickness of about 0.1 mm or greater, cooling effect may be excellent, and when heat insulation coating is formed to have a thickness of 0.15 mm or greater, heat insulation effect may be excellent. Accordingly, in consideration of coating production efficiency and costs, heat radiation coating thickness suitably may be from about 0.08 to about 0.12 mm, and heat insulation coating thickness suitably may be from about 0.13 to about 0.17 mm.

Meanwhile, the present invention provides a method for producing a cylinder liner for insert casting, which may include: forming a first heat radiation coating layer on an upper outer circumference surface of a cylinder liner; and forming a heat insulation coating layer on a lower outer circumference surface of the cylinder liner. In particular, the heat insulation coating layer may have a lower thermal conductivity than that of the first heat radiation coating layer.

The method of forming the coating layer may not be particularly limited and can be selected from coating methods well-known in the art.

In addition, the method may further include, after forming the heat radiation coating layer on the upper outer circumference surface of the cylinder liner, further forming a second heat radiation coating layer on the heat insulation coating layer and the heat radiation coating layer.

Figure 7:
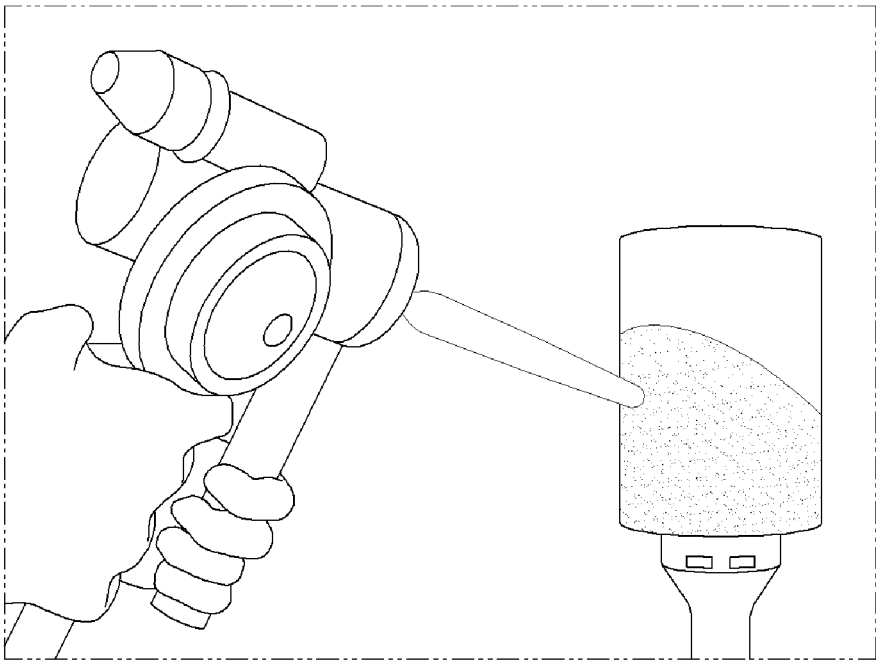
FIG. 7 is an image showing an exemplary thermal spray coating process conducted on an outer circumference surface of a cylinder liner according to an exemplary embodiment of the present invention.

FIG. 7 illustrates an exemplary thermal spray coating process conducted on an outer circumference surface of a cylinder liner. First, a non-combustion chamber disposed in a lower part of a combustion chamber, which requires heat insulation, may be preferably coated. A lower part of the combustion chamber (i.e., non-combustion chamber) may be subjected to thermal spray coating using a material containing a mixture of an amount of about 93 wt % a zirconium dioxide powder and an amount of about 7 wt % of yttrium oxide, based on the total weight of the coating material, by plasma thermal spraying.

After heat insulation coating, the upper part of the cylinder liner, which may be a combustion chamber, may be coated to form a first heat radiation coating and electric arc thermal spray coating suitably may be conducted using an aluminum material wire. Then, the cylinder block may be cast by inserting a multilayer coated liner to produce parts.

In addition, the heat insulation coating layer may be coated by the thermal spray coating using a coating material containing an amount of about 5 to 20 wt % of yttrium oxide based on the total weight of the coating material and of zirconium dioxide constituting the remaining balance thereof.

In addition, the heat radiation coating layer may be formed by electric arc thermal spray coating using a coating material containing 100 wt % of aluminum, or an amount of about 8 to 12 wt % of silicon based on the total weight of the coating material and aluminum constituting the remaining balance thereof.

According to various exemplary embodiments, the present invention provides a cylinder liner for insert casting and a method for manufacturing the same, and the cylinder liner may have the functions of cooling and warming suitable for functions of respective parts by imparting multiple layers having different thermal conductivities to the cylinder liner in order to solve the problem of unsmooth cooling and warming of respective parts of conventional cylinder liners for insert casting in the related arts.

Further, the cylinder liner for insert casting and a method for manufacturing the same may have effects of considerably improving cooling and warming properties suitable for functions of respective parts of the bore by imparting multi-stage thermal conductivity as compared to conventional cylinder liners.

In addition, in the cylinder liner for insert casting and the method for manufacturing the same according to the present invention, cooling may be reinforced by applying heat radiation coating to an upper part of a combustion chamber bore to maximize functions of a cylinder bore, and cooling of piston slideway oil may be prevented and friction may be thus reduced. Moreover, functions of cooling the combustion chamber and warming oils of piston slideway can be obtained by applying heat insulation coating having lower thermal conductivity than that of the heat radiation coating layer to middle and lower parts requiring warming.

Although the various exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cylinder liner for insert casting comprising:

a first heat radiation coating layer on an outer circumference surface of an upper part of a cylinder liner; and a heat insulation coating layer on an outer circumference surface of a middle and a lower part of the cylinder liner, wherein the heat insulation coating layer has a lower thermal conductivity than a thermal conductivity of the first heat radiation coating layer and the heat insulation coating layer comprises yttrium oxide ($Y_2O_3$) and zirconium dioxide ($ZrO_2$).

2. The cylinder liner according to claim 1, further comprising a second heat radiation coating layer formed on the first heat radiation coating layer of the upper outer circumference surface and on the heat insulation coating layer of the lower outer circumference surface.

3. The cylinder liner according to claim 1, wherein the first heat radiation coating layer comprises of an aluminum (Al) material.

4. The cylinder liner according to claim 1, wherein the first heat radiation coating layer comprises an amount of about 8 to 12 wt % of silicon (Si) and aluminum (Al) constituting the remaining balance of the first heat radiation layer, based on the total weight of the first heat radiation coating layer.

5. The cylinder liner according to claim 2, wherein the second heat radiation coating layer comprises of an aluminum (Al) material.

6. The cylinder liner according to claim 2, wherein the second heat radiation coating layer comprises an amount of about 8 to 12 wt % of silicon (Si) and aluminum (Al) constituting the remaining balance of the second heat radiation layer, based on the total weight of the second heat radiation coating layer.

7. The cylinder liner according to claim 1, wherein the first heat radiation coating layer has a thickness of about 0.02 to 0.3 mm.

8. The cylinder liner according to claim 2, wherein the second heat radiation coating layer has a thickness of about 0.02 to 0.3 mm.

9. The cylinder liner according to claim 2, wherein the first heat radiation coating layer or the second heat radiation coating layer is formed by thermal spraying.

10. The cylinder liner according to claim 9, wherein the thermal spraying is either flame thermal spraying or electric arc thermal spraying.

11. The cylinder liner according to claim 1, wherein the heat insulation coating layer comprises aluminum oxide ($Al_2O_3$).

12. The cylinder liner according to claim 10, wherein the heat insulation coating layer comprises an amount of about 5 to 20 wt % of yttrium oxide and zirconium dioxide constituting the remaining balance of the heat insulation layer, based on the total weight of the heat insulation coating layer.

13. The cylinder liner according to claim 1, wherein the heat insulation coating layer has a thickness of about 0.13 to 0.17 mm.

14. A method for producing a cylinder liner for insert casting comprising:

forming a first heat radiation coating layer on an upper outer circumference surface of a cylinder liner; and forming a heat insulation coating layer on a middle and a lower outer circumference surface of the cylinder liner, wherein the heat insulation coating layer has a lower thermal conductivity than a thermal conductivity of the first heat radiation coating layer and the heat insulation coating layer comprises yttrium oxide ($Y_2O_3$) and zirconium dioxide ($ZrO_2$).

15. The method according to claim 14, further comprising:

forming a second heat radiation coating layer on the heat insulation coating layer and the first heat radiation coating layer, after forming the first heat insulation coating layer on the lower outer circumference surface of the cylinder liner.

16. The method according to claim 14, wherein the heat insulation coating layer is formed by a thermal spray coating using a coating material comprising an amount of about 5 to 20 wt % of yttrium oxide based on the total weight of the coating material and of zirconium dioxide constituting the remaining balance of the coating material.

17. The method according to claim 14, wherein the first heat radiation coating layer is formed by an electric arc thermal spray coating using a coating material comprising 100 wt % of aluminum, or an amount of about 8 to 12 wt % of silicon based on the total weight of the coating material and aluminum constituting the remaining balance of the coating material.

18. The method according to claim 15, wherein the second heat radiation coating layer is formed by an electric arc thermal spray coating using a coating material comprising 100 wt % of aluminum, or an amount of about 8 to 12 wt % of silicon based on the total weight of the coating material and aluminum constituting the remaining balance of the coating material.

19. A vehicle comprising a cylinder liner of claim 1.

* * * * *